US011167168B1

(12) United States Patent
Ellis

(10) Patent No.: US 11,167,168 B1
(45) Date of Patent: Nov. 9, 2021

(54) INDIRECT ALIGNMENT PIVOT MECHANISM FOR SEATED LEG EXERCISING MACHINES

(71) Applicant: Joseph K. Ellis, Ocala, FL (US)

(72) Inventor: Joseph K. Ellis, Ocala, FL (US)

( * ) Notice: Subject to any disclaimer, the term of this patent is extended or adjusted under 35 U.S.C. 154(b) by 0 days.

(21) Appl. No.: 16/986,350

(22) Filed: Aug. 6, 2020

(51) Int. Cl.
*A63B 21/00* (2006.01)
*A63B 23/04* (2006.01)

(52) U.S. Cl.
CPC .... *A63B 21/4047* (2015.10); *A63B 21/00076* (2013.01); *A63B 21/4031* (2015.10); *A63B 23/0494* (2013.01)

(58) Field of Classification Search
CPC ..... A63B 21/00076; A63B 21/15; A63B 21/159; A63B 21/4031; A63B 21/4045; A63B 21/4047; A63B 23/04; A63B 23/0494
See application file for complete search history.

(56) References Cited

U.S. PATENT DOCUMENTS 4,254,949 A * 3/1981 Brentham ..... A63B 23/03516 482/112
4,441,708 A * 4/1984 Brentham ..... A63B 23/03516 482/112
2004/0033871 A1* 2/2004 Ma ..... A63B 21/4035 482/142
2017/0106235 A1* 4/2017 Carter ..... A63B 21/154
2018/0147436 A1* 5/2018 Ellis ..... A63B 23/03558

* cited by examiner

*Primary Examiner* — Jennifer Robertson
(74) *Attorney, Agent, or Firm* — Laurence P. Colton; Smith Tempel Blaha LLC

(57) ABSTRACT

A seated leg extension exercise station and or a seated leg curl exercise station integrated into an exercise machine comprising an indirect alignment pivot mechanism to control the motion of the user engagement ankle pads such that the user's ankles and the machine's ankle pads are aligned to move in the same arcing path throughout the exercise motion and wherein all of the components of the indirect alignment pivot mechanism are located below the top surface of the seat pad during at least a portion of the exercise motion such that there is unobstructed access to the top surface of the seat pad when the user enters and exits the machine.

15 Claims, 7 Drawing Sheets

INDIRECT ALIGNMENT PIVOT MECHANISM FOR SEATED LEG EXERCISING MACHINES

BACKGROUND OF THE INVENTION

Technical Field

This invention relates to the general technical field of exercise, physical fitness and physical therapy equipment and machines. This invention relates more specifically to the field of seated position exercise machines with a pivoting mechanism for leg exercising stations.

Prior Art

Exercise, physical fitness, and physical therapy equipment and machines are available in various configurations and for various purposes, and are available for all of the major muscle groups. Some machines have a single user support and a single exercise station with a single resistance mechanism. Other machines have a single user support and multiple exercise stations that can be operated from the single user support so as to allow a user to exercise multiple muscle groups on a single machine with a single resistance mechanism. Other machines may have multiple user supports and multiple exercise stations that can work various muscle groups and each station may have its own resistance mechanism.

Many of these machines place a user in the seated position and utilize a commonly known pivoting mechanism for exercising a user's legs. These mechanisms are known as a leg extension for exercising a user's quadricep muscles and a leg curl for exercising a user's hamstring muscles. These exercises are referred to as single joint movements where the user's lower legs pivot about the user's knees and the user's upper legs remain mostly stationary during the exercise motion. For these exercises when a user starts from a bent legs position and moves to an extended legs position, this exercise motion is referred to as a leg extension. For these exercises when a user starts from an extended legs position and moves to a bent legs position, this exercise motion is referred to as a leg curl. To resist these exercise motions, prior art machines comprise a single pivoting arm with a pivot component attached to a first end and one or more ankle pads attached proximal to a second end of the pivoting arm. Generally, the pivotable end of the pivot arm is positioned just above the front edge of the seat pad and the ankle pads end of the pivot arm contact the user's lower legs on or just above the user's ankles. For leg extension exercises the ankle pads would contact the front of the user's legs. For leg curl exercises the ankle pads would contact the back of the user's legs. The pivot arm is operatively connected to a resistance mechanism to resist the exercise motion of the user's legs. Leg extension stations generally place the user in a seated position. Leg curl stations may place the user in a seated, prone or standing position. The current invention is an improvement to seated pivoting leg extension exercise stations and seated leg curl exercise stations.

In prior art designs as illustrated in Prior Art FIGS. 1 and 2, seated pivoting leg exercises stations are designed such that the user's knee joints must be in a direct line with the pivoting component of the pivoting arm so as to replicate the arcing motion of the user's lower legs as they pivot about the user's knee joint. This direct alignment motion is designed to keep the pivot arm ankle pads generally in contact with the user's legs at a fixed location throughout the range of the exercise motion. Prior to the current invention, if the user's knee joints are not directly in line with the pivot component of the pivoting arm the ankle pads will move along the user's lower legs during the exercise motion and may hinder the motion because the user's lower legs and the pivoting arm would be moving in different planes of arcing motions.

In a first configuration of these prior art seated leg exercise stations as illustrated in Prior Art FIG. 1, the pivoting arm is attached to the machine such that the pivot component of the pivoting arm protrudes above the front end of the center of the seat pad which is in the path of the user as they enter and exit the machine. While operating this configuration of the machine, the user is straddling the pivot component so that the pivoting component is directly in line with the user's knee joint. The undesirable feature of this configuration is that the protruding pivot component of the pivoting arm partially blocks the user's entry and exit of the machine. Users can accidentally contact the rigid pivot component with their knees or legs while moving over or around the pivot component as they enter or exit the machine causing potential pain and or injury. The current invention eliminates the problems associated with this prior art configuration.

In a second configuration of these prior art seated leg exercise stations as illustrated in Prior Art FIG. 2, the pivoting arm is attached to one side of the machine such that the pivot component of the pivoting arm is in line with the user's knee joint in the seated position. This leaves the center seat section and one side of the seat unobstructed as the user enters and exits the machine but obstructs one side of the seat entry and exit. One undesirable feature of this configuration is that it requires the ankle pads to be attached to an arm that extends from the side pivoting arm to form an approximate "L" shape such that when the user urges the ankle pads during the exercise motion the load force that the extended arm places on the pivoting arm is offset and therefore requires much more robust and costly components to prevent twisting of the extended arm and keep an even resistance on each of the user's legs. Another undesirable feature of this second prior art configuration is that the components required for the side pivoting arm to operate properly can obstruct certain features, components or other exercise stations of the exercise machine. The current invention also eliminates the problems associated with this prior art configuration.

BRIEF SUMMARY OF THE INVENTION

The present invention provides an indirect alignment pivoting motion mechanism to a seated leg extension or seated leg curl exercise station wherein the components of the mechanism are located below the seat pad and within or mostly within the vertical planes of the left and right sides of the seat pad. The mechanism is configured such that a drive bar with a pivot component at a first end and a pivot component at a second end is attached at the first end proximal to the center of the machine frame and proximal to the forward end of the machine frame and in close proximity to the underside of the seat pad. The second end of the drive bar is pivotally connected to a forward portion of a slidable alignment positioning bar. The rearward end of said alignment positioning bar is pivotally connected to movable carriage that is horizontally or close to horizontally slidable and said slide carriage is rollably or slidably engaged with a guide bar that extends horizontally or close to horizontal most of the length of the lower portion of the machine frame.

An ankle pads assembly is attached to the pivotable connection of the second end of the drive bar and the first pivot of the alignment positioning bar such that the forward end of the alignment positioning bar and the ankle pads assembly are rigidly connected and pivot on the second end of the drive bar during the exercise motion. One or more ankle pads are pivotally connected to the ankle pads assembly.

A resistance mechanism is operatively connected to at least one component of the indirect alignment pivot mechanism. During operation of the machine the sliding and pivoting components of the indirect alignment pivot assembly create an arcing path of motion of the ankle pads that replicates the arcing path of motion of the user's ankles.

The present invention creates an unobstructed entry and exit to the seat pad from the left, right or center direction and does not require any space on the left or right sides of the seat pad or machine frame and is therefore a substantial improvement to seated pivoting leg exercises stations and machines.

All embodiments of the invention can be operatively connected to various mechanisms or components to create resistance to the exercise motions.

DETAILED DESCRIPTION OF PREFERRED EMBODIMENTS

Figure 1:
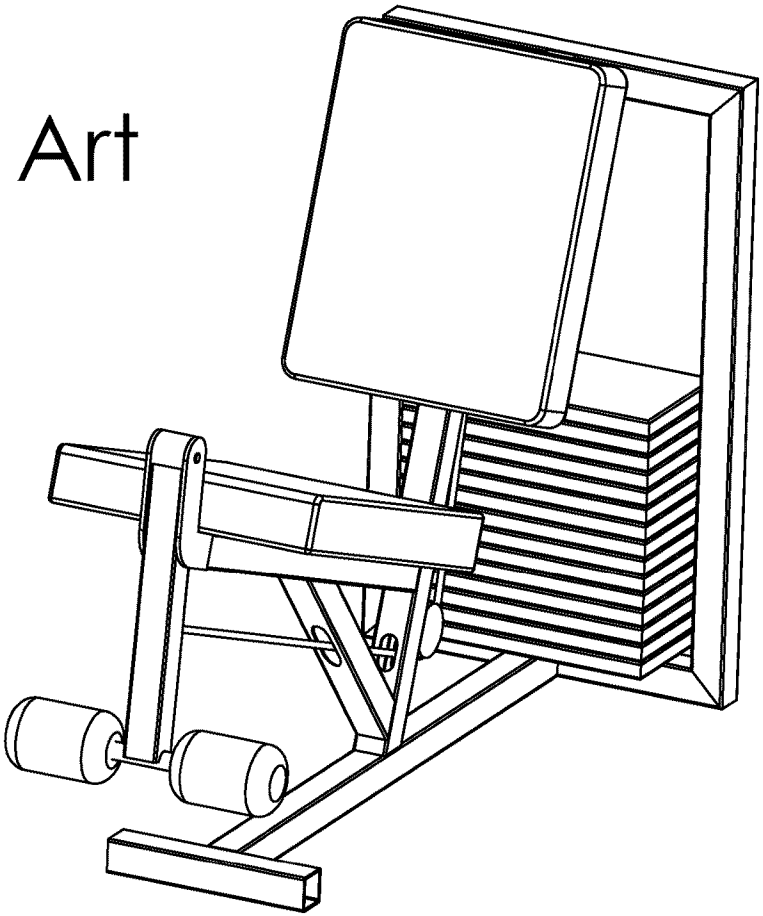
Prior Art Figure 1
FIG. 1 is a view of a prior art machine showing a center pivoting arm for a leg extension exercise machine.
Figure 2:
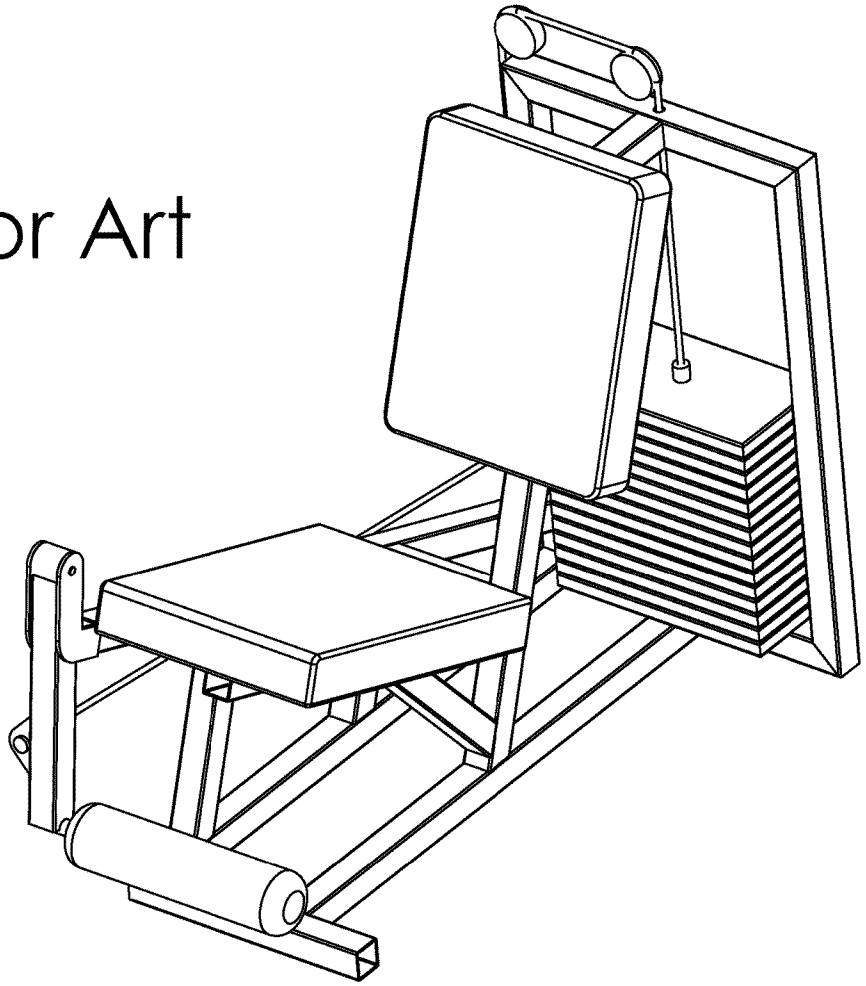
Prior Art Figure 2
FIG. 2 is a view of a prior art machine showing a side pivoting arm for a leg extension exercise machine.

Exemplary preferred embodiments are disclosed below in connection with the attached drawings. Throughout this specification, various terms will be used to describe various components or features of the invention. For example, the term "machine" or "exercise machine" will refer to any machine that can be operatively connected to the invention to create a seated pivoting leg exercises motion. The term "forward" or "front" when describing a component or section of the exercise machine will refer to the end of the machine more distal to the resistance mechanism. The term "rearward" or "rear" when describing a component or section of the exercise machine will refer to the end of the machine more proximal to the resistance mechanism. The term "exercise station" refers to the components and assemblies that produce the exercise motion created by the indirect alignment pivot mechanism. Other components of an exercise machine can also be a part of the exercise station including but not limited to the user support components, the resistance mechanism components, and a user interface console. Other exercise stations on a single exercise machine can share the common components of the exercise machine such as the user support, resistance mechanism, and user interface console. The term "pivot" may refer to a bearing, rotary component, or other rotational feature of the invention. The term "common pivot" will refer to a location where two components are coupled and rotate or pivot at the same location. The term "bar" as part of a description of a component will refer to an elongated tube or rod that is generally made of metal or an equivalent material. The term "slide" as part of a description of a component will refer to a component or assembly that moves in a linear motion and may roll on wheels or can slide on low friction components. The term "ankle pads" will refer to user contact pads that are often round in shape but can be made in any shape that comfortably contacts a user's ankle area to transfer force from the user's legs to the resistance mechanism of the exercise machine. The term "start" or "starting position" when referring to an exercise motion will refer to the proximal location where most users would begin the range of motion of a certain exercise for a certain muscle group. The term "finish" or "finishing position" when referring to an exercise motion will refer to the proximal location where most users would complete the range of motion of a certain exercise for a certain muscle group. The term "resistance mechanism" will refer to the components of an exercise machine utilized to create resistance to the exercise motion of the invention.

FIGS. 3-7 are all views of a preferred embodiment of the invention this inventor terms "An Indirect Alignment Pivot Mechanism for Seated Leg Exercising Machines". Generally, the invention is a device or mechanism that is operatively connected to an exercise machine for creating an arcing path of motion that aligns with an exercise path of motion of a user's lower leg as the user extends and contracts their lower legs from the knee joint in a seated position. The invention however creates this alignment with all of the components of the invention mechanism located below the seat and mostly within the vertical boundaries of the side planes of the seat during at least a portion of the exercise motion such that there is no direct alignment of the user's knee joint with any portion of the mechanism. The invention is an improvement to pivoting seated leg exercises in that it removes any obstruction from entering or exiting the machine and does not require any space on either side of the machine. The components and supporting structure of the invention and exercise machine can be constructed of any material capable of supporting and operating the invention and exercise machine with metal components being the most common component material.

Referring now to FIGS. 3-7, various views and configurations of a preferred embodiment of the device are shown to provide a more complete understanding of the invention. In this embodiment, the assemblies and components of the indirect alignment pivot mechanism 1 are mounted on the structural support frame 101 of machine 100 and indirect alignment pivot mechanism 1 is operatively connected to a resistance mechanism 50 to provide resistance to the exercise motion. The seat pad 2 is the main support for user U on the exercise machine.

As disclosed in the illustrated preferred embodiments, indirect alignment pivot mechanism 1 is comprised of slide carriage assembly 20, ankle pads assembly 30, resistance mechanism 50, and individual components including seat pad 2 which has a cushioned planar surface and generally has an angle that is slightly above horizontal, drive bar 3 which is generally an elongated "L" shape tube or rod, drive bar first pivot 4, drive bar second pivot 5, resistance drive linkages connection bar 6 which is an elongated tube or rod, resistance drive linkages pivot 7, and first resistance drive linkage bar 8 and second resistance drive linkage bar 9 which are elongated tubes or rods.

Slide carriage assembly 20 is comprised of slide carriage frame 21 which is constructed of two opposing triangular shaped plates, slide carriage wheels 22, slide carriage guide bar 23 which is an elongated tube or rod, alignment positioning bar 24 which is an elongated tube or rod, alignment positioning bar first pivot 25, and alignment positioning bar second pivot 26. Slide carriage assembly 20 is illustrated as a rolling assembly, but various low friction components such as linear bearings could be used to transport slide carriage assembly 20. Slide carriage assembly 20 is illustrated with a three-wheel configuration to transport and keep slide carriage assembly 20 securely engaged with slide carriage bar 23, however various other wheel configurations could also be used to create similar results.

Ankle pads assembly 30 is comprised of ankle pads assembly connection bars 31 which are elongated tubes or rods, ankle pads assembly pivot support bar 32 which is an elongated tube or rod, ankle pads pivot 33, front ankle pads pivot connection bar 34 which is an elongated tube or rod, front ankle pads 35 which are an elongated round shaped with an outer cushioning material, rear ankle pads pivot connection bar 36 which is an elongated bar or rod, and rear ankle pads 37 which are an elongated round shape with an outer cushioning material.

Resistance assembly 50 is illustrated as a rotational flywheel resistance, but indirect alignment pivot mechanism 1 can be connected to various resistance components or mechanisms to resist the exercise motion of indirect alignment pivot mechanism 1 including but not limited to weights or stacks of weight, fluid motion assemblies, rotational flywheel and fan assemblies, electrical assemblies, and other mechanized resistance systems or combinations thereof including resistance mechanisms that create resistance in the leg extension direction only or the leg curl direction only or in the leg extension direction and leg curl direction of the exercise motion. Although not illustrated, another preferred embodiment of the invention can comprise independently left and right side indirect alignment pivot mechanisms 1 that are each operatively connected to a resistance mechanism. In this alternative embodiment, there would be two mostly identical sets of each components except for the seat and ankle pads. In this alternative embodiment, the user would be able to exercise their left leg independently of their right leg.

As illustrated in the preferred embodiment of FIGS. 3-7, the components of the indirect alignment pivot mechanism 1 are assembled such that a first end of drive bar 3 is pivotally connected to structural support frame 101 below a forward and center section of seat pad 2 with drive bar first pivot 4 and a second end of drive bar 3 is pivotally connected to a forward section of alignment positioning bar 24 with drive bar second pivot 5. The slide carriage assembly 20 is constructed such that a set of slide carriage wheels 22 that are housed in slide carriage frame 21 and mounted on slide carriage guide bar 23 and slide carriage guide bar 23 is rigidly connected at a first end to a forward section of structural support frame 101 and slide carriage guide bar 23 is rigidly connected at a second end to a rearward section of structural support frame 101. A central section of slide carriage frame 21 is pivotally connected to the second end of alignment positioning bar 24 with alignment positioning bar second pivot 26 and the first end of alignment positioning bar 24 is pivotally connected to the drive bar second pivot 5 with alignment positioning bar first pivot 25.

Ankle pads assembly 30 is constructed such that a first end of ankle pads assembly connection bars 31 are rigidly connected to alignment positioning bar first pivot 25 such that ankle pads assembly 30 and alignment positioning bar 24 pivot as one rigid structure on drive bar second pivot 5. A second end of ankle pads assembly connection bars 31 are rigidly connected to a first end of ankle pads assembly pivot support bar 32 and a second end of ankle pads assembly pivot support bar 32 is connected to a first end of front ankle pads pivot connection bar 34 with ankle pads pivot 33 and front ankle pads 35 have a perpendicular connection proximal to a second end of front ankle pads pivot connection bar 34. A first end of rear ankle pads pivot connection bar 36 is pivotally connected to a second end of ankle pads assembly pivot support bar 32 with ankle pads pivot 33 and rear ankle pads 37 have a perpendicular connection proximal to a second end of rear ankle pads pivot connection bar 36. Although not illustrated, the indirect alignment pivot mechanism 1 also can be configured with a one directional resistance and one set of ankle pads such that only front ankle pads 35 would be pivotally connected to ankle pads assembly 30 for performing leg extension exercises or only rear ankle pads 37 would be pivotally connected to ankle pads assembly 30 for performing leg curl exercises.

In all preferred embodiments, indirect alignment pivot mechanism 1 is operatively connected to a resistance mechanism 50. As illustrated herein, first end of resistance drive linkages connection bar 6 is rigidly connected to drive bar first pivot 4 and a second end of resistance drive linkages connection bar 6 is pivotally connected to a first end of first resistance drive linkage bar 8 with resistance drive linkages pivot 7 and a second end of resistance drive linkages connection bar 6 is also connected to a first end of second resistance drive linkage bar 9 with resistance drive linkages pivot 7. A second end of first resistance drive linkage bar 8 is operatively connected to resistance mechanism 50 and a second end of second resistance drive linkage bar 9 is operatively connected to resistance mechanism 50. As illustrated, the indirect alignment pivot mechanism 1 is configured with a first resistance drive linkage bar 8 and a second resistance drive linkage bar 9 to provide bi-directional resistance to the leg extension exercise motion and the leg curl exercise motion; however, if the indirect alignment pivot mechanism 1 is operatively connected with a one directional resistance mechanism, only one resistance drive linkage bar may be used or various types of linkage components may connect the motion of the indirect alignment pivot mechanism 1 to various types of resistance mechanisms.

Figure 3:
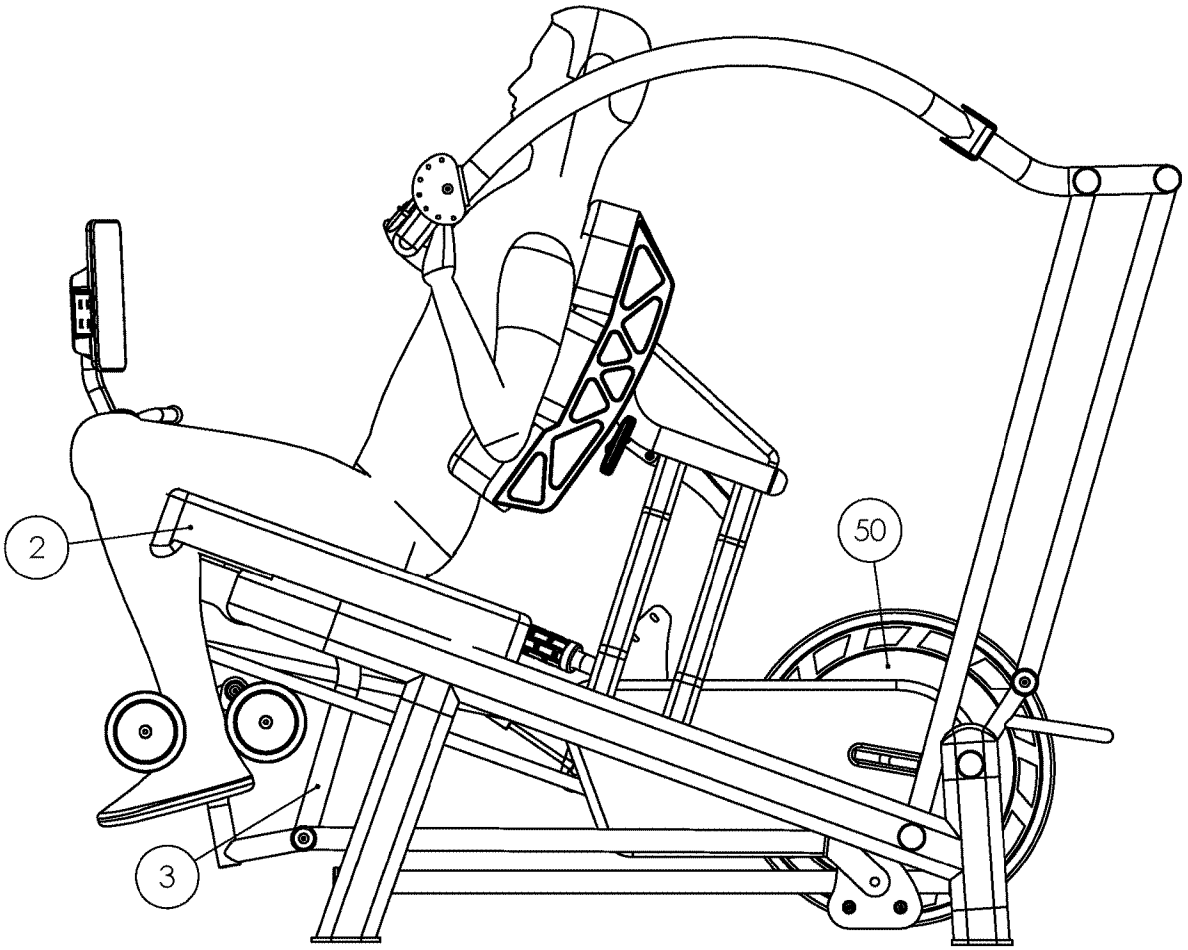
FIG. 3 is a side view of the invention with a user in the start position for a leg extension exercise or the finish position for a leg curl exercise.

To operate a seated forward pushing leg extension exercise motion with the indirect alignment pivot mechanism 1 on exercise machine 100, user U enters the machine in a seated position on seat pad 60 and places their ankles behind front ankle pads 35 so their lower legs will be positioned mostly vertical in a bent knees position as illustrated in FIG. 3. To start the exercise motion, user U urges front ankle pads 35 forward and upward as user U's ankles pivot about user U's knee joints. This would cause a concurrent motion of several components such that the first end of drive bar 3 will pivot forward about drive bar first pivot 4, causing a second end of drive bar 3 which is pivotably connected to a first end of alignment positioning bar 24 at drive bar second pivot 5 and alignment positioning bar first pivot 25 to move forward and upward. This would cause the first end of alignment positioning bar 24 to slide towards the forward end of machine 100 and angle upward as the second end of alignment positioning bar 24 slides forward on slide carriage assembly 20 and pivots on slide carriage assembly 20 as slide carriage assembly 20 slides from the rearward end of machine 100 towards the forward end of machine 100 on slide carriage guide bar 23. This also causes ankle pads assembly 30 which is rigidly connected to alignment positioning bar first pivot 25 with a first end of ankle pads assembly connection bars 31 to move forward and upward. As front ankle pads 35 move forward and upward, the first end of front ankle pads connection bar 34 will pivot about ankle pads pivot 33 as the rigid connection of ankle pads assembly 30 and alignment positioning bar 24 pivot on second drive bar pivot 5. These combined pivoting and sliding motions of the components and assemblies of indirect alignment pivot mechanism 1 cause front ankle pads 35 to follow the natural arcing motion of user U's ankles as they move through a leg extension exercise motion from a bent legs starting position to an extended legs finishing position. During this leg extension exercise motion resistance drive linkages connection bar 6 will pivot about drive bar first pivot 4 and first resistance drive linkage bar 8 and second resistance drive linkage bar 9 will pivot on resistance drive linkages pivot 7 as first resistance drive linkage bar 8 and second resistance drive linkage bar 9 cooperate with resistance mechanism 50 to create a resistance to the leg extension exercise motion of indirect alignment mechanism 1 and machine 100. Various other types of resistance linkage components and resistance mechanisms can be cooperatively engaged with the exercise motion of indirect alignment mechanism 1 and machine 100.

Figure 4:
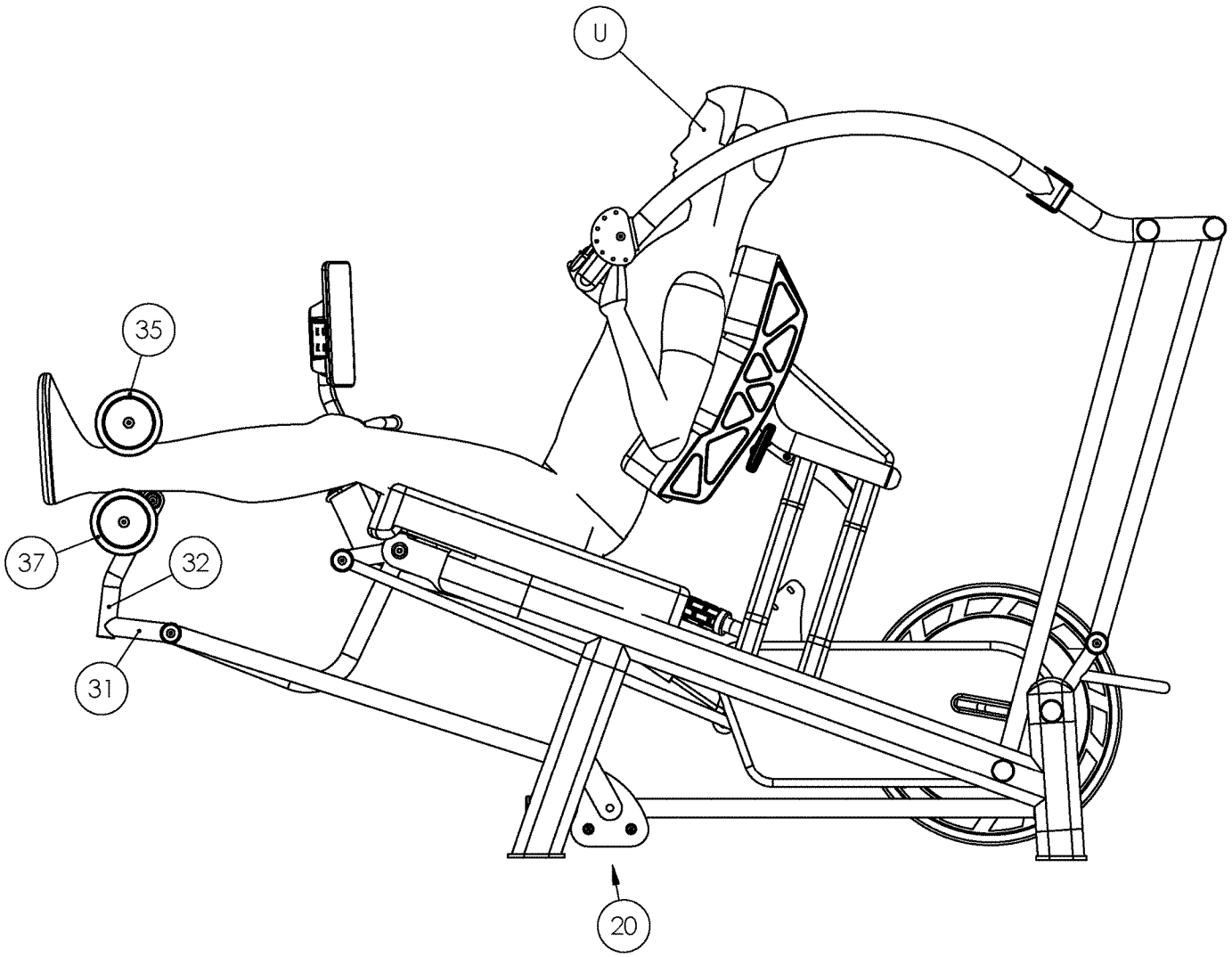
FIG. 4 is a side view of the invention with a user in the start position for a leg curl exercise or the finish position for a leg extension exercise.
Figure 5:
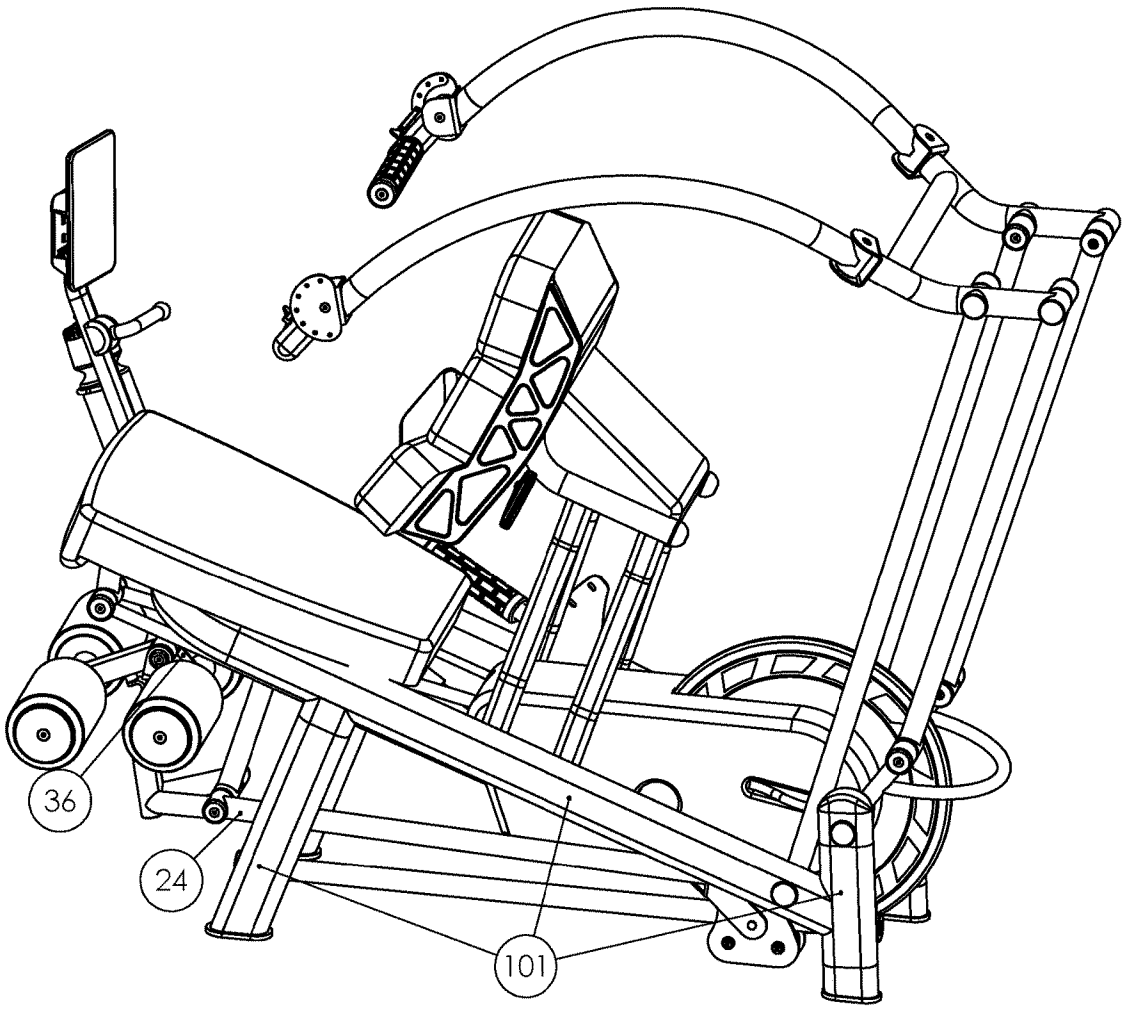
FIG. 5 is a top side perspective view of the invention.
Figure 6:
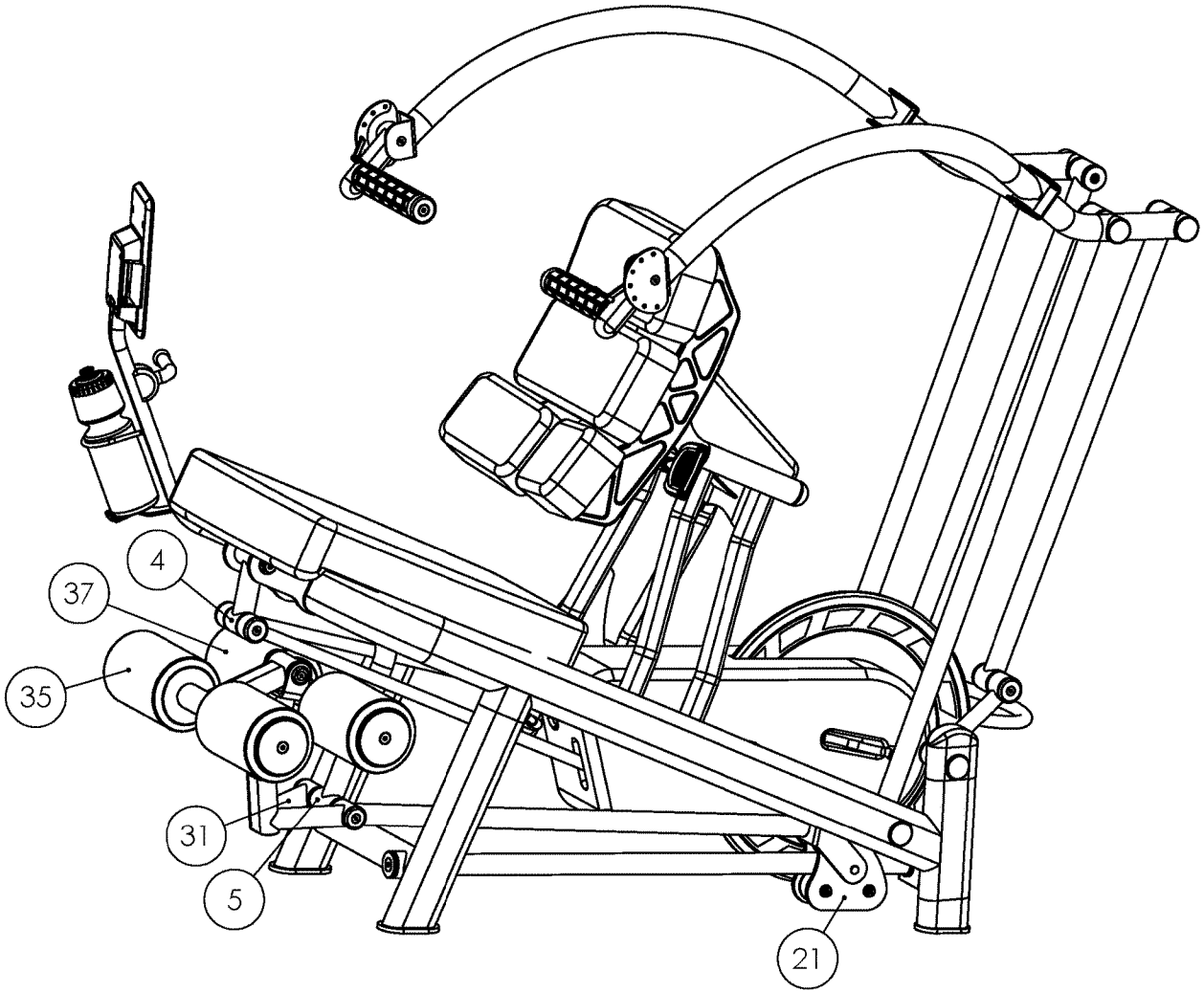
FIG. 6 is a front side perspective view of the invention.
Figure 7:
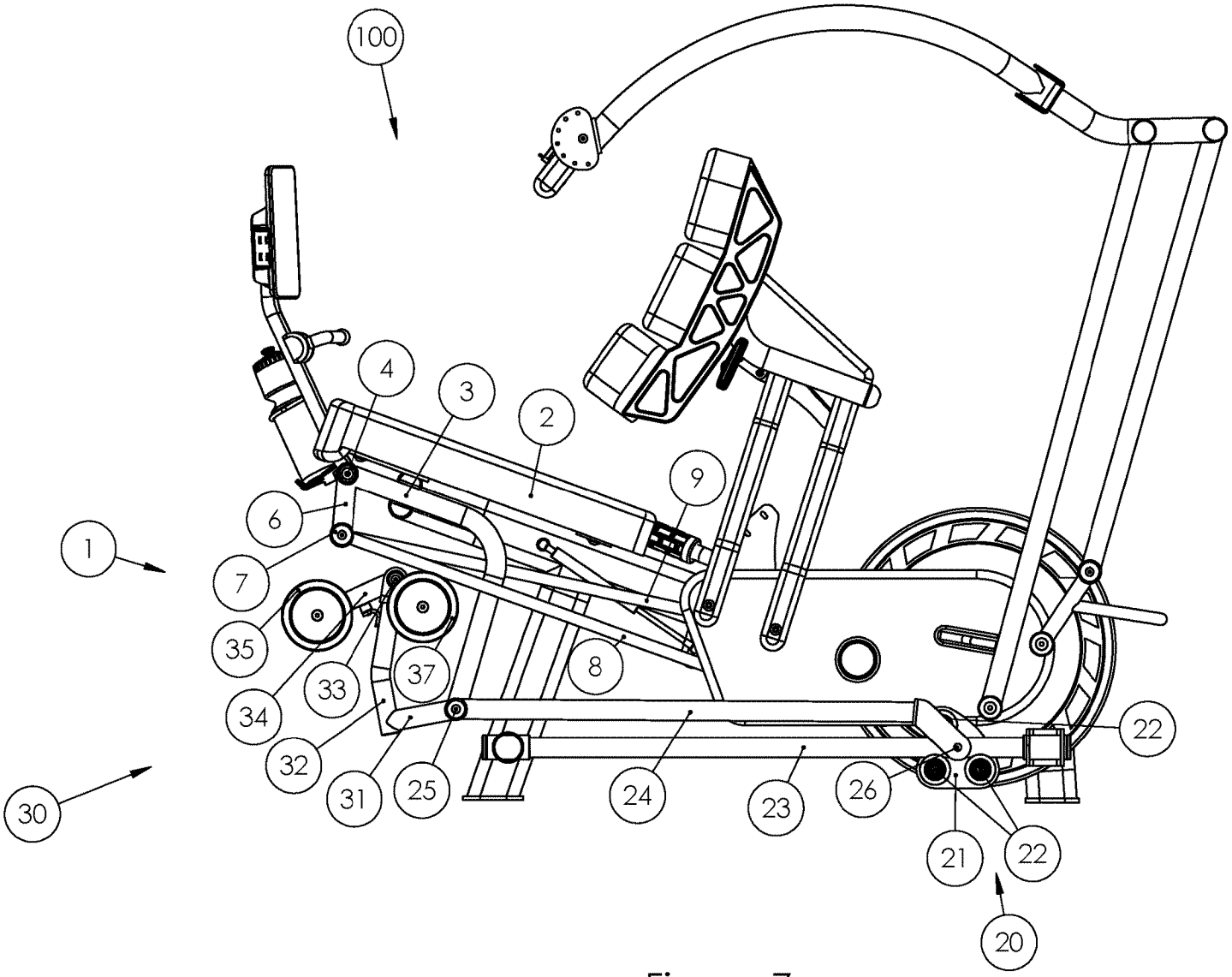
FIG. 7 is a side view of the invention with a portion of the structural support frame removed to illustrate an unobstructed view of the components and features of the mechanism.

To operate a seated rearward pulling leg curl exercise motion with the indirect alignment pivot mechanism 1 on exercise machine 100, user U enters the machine in a seated position on seat pad 60 and places their ankles over rear ankle pads 37 so their lower legs will be extended to a mostly horizontal and straight legs position as illustrated in FIG. 4. To start the exercise motion, user U urges rear ankle pads 37 downward and rearward as user U's ankles pivot about user U's knee joints. This would cause a concurrent motion of several components such that the first end of drive bar 3 will pivot rearward about drive bar first pivot 4, causing a second end of drive bar 3 which is pivotably connected to a first end of alignment positioning bar 24 at drive bar second pivot 5 and alignment positioning bar first pivot 25 to move rearward and downward. This would cause a first end of alignment positioning bar 24 to slide rearward and angle downward as the second end of alignment positioning bar 24 slides rearward on slide carriage assembly 20 and pivots on slide carriage assembly 20 as slide carriage assembly 20 slides from the forward end of machine 100 towards the rearward end of machine 100 on slide carriage guide bar 23. This also causes ankle pads assembly 30 which is rigidly connected to alignment positioning bar first pivot 25 with a first end of ankle pads assembly connection bars 31 to move rearward and downward. As rear ankle pads 37 move rearward and downward, the first end of rear ankle pads connection bar 36 will pivot about ankle pads pivot 33 as the rigid connection of ankle pads assembly 30 and alignment positioning bar 24 pivot on second drive bar pivot 5. These combined pivoting and sliding motions of the components and assemblies of indirect alignment pivot mechanism 1 cause rear ankle pads 37 to follow the natural arcing motion of user U's ankles and they move through a seated leg curl exercise motion from a straight legs starting position to a bent legs finishing position. During this leg curl exercise motion resistance drive linkages connection bar 6 will pivot about drive bar first pivot 4 and first resistance drive linkage bar 8 and second resistance drive linkage bar 9 will pivot on resistance drive linkages pivot 7 as first resistance drive linkage bar 8 and second resistance drive linkage bar 9 cooperate with resistance mechanism 50 to create a resistance to the exercise motion of indirect alignment mechanism 1 and machine 100. Various other types of resistance linkage components and resistance mechanisms can be cooperatively engaged with the exercise motion of indirect alignment mechanism 1 and machine 100.

FIGS. 3-7 illustrate the indirect alignment pivot mechanism 1 operatively connected to an exercise machine 100 with a single user support and multiple exercise stations. However, the indirect alignment pivot mechanism 1 also can be operatively connected to an exercise machine that comprises one user support and no other exercise stations except for the indirect alignment pivot mechanism 1, or the indirect alignment pivot mechanism 1 can also be operatively connected to an exercise machine that has multiple user supports and various exercise stations including the indirect alignment pivot mechanism 1.

Features and components of the preferred embodiment of the present invention include at least one pivoting drive bar, at least one alignment positioning bar, at least one slide carriage assembly, at least one ankle pads assembly, and at least one resistance mechanism wherein all of the components are operatively mounted on or operatively connected to an exercise machine to provide seated indirect alignment pivoting leg exercise motions.

While the invention has been described in connection with certain preferred embodiments, it is not intended to limit the spirit or scope of the invention to the particular forms set forth, but is intended to cover such alternatives, modifications, and equivalents as may be included within the true spirit and scope of the invention as defined by the appended claims.

LIST OF REFERENCE NUMERALS

1. Indirect alignment pivot mechanism
2. Seat pad
3. Drive bar
4. Drive bar first pivot
5. Drive bar second pivot
6. Resistance drive linkages connection bar
7. Resistance drive linkages pivot
8. First resistance drive linkage bar
9. Second resistance drive linkage bar
20. Slide carriage assembly
21. Slide carriage frame
22. Slide carriage wheel
23. Slide carriage guide bar
24. Alignment positioning bar
25. Alignment positioning bar first pivot
26. Alignment positioning bar second pivot
30. Ankle pads assembly
31. Ankle pads assembly connection bars
32. Ankle pads assembly pivot support bar
33. Ankle pads pivot
34. Front ankle pads pivot connection bar
35. Front ankle pads
36. Rear ankle pads pivot connection bar
37. Rear ankle pads
50. Resistance mechanism
100. Exercise machine
101. Structural support frame
U. User

What is claimed is:

1. An indirect alignment pivot mechanism for seated leg exercising machines comprising:

a) a structural support frame having a forward end and a rearward end;

b) a seated position user support including a seat pad mounted on the structural support frame proximal to the forward end;

c) a drive bar with a pivotable first end and a pivotable second end wherein the first end of the drive bar is connected to the structural support frame below a surface plane of the seat pad such that a pivot axle of the first end of the drive bar is located below the surface plane of the seat pad;

d) at least one alignment positioning bar with a pivotable first end and a pivotable second end wherein the first end of the at least one alignment positioning bar is pivotally connected to the second end of the drive bar;

e) at least one horizontal or low angled slide carriage guide bar having a first end rigidly connected below the seat pad proximal to the forward end of the structural support frame and a second end rigidly connected below the seat pad proximal to the rearward end of the structural support frame;

f) at least one slide carriage slidably engaged with the at least one slide carriage guide bar and the at least one slide carriage is pivotally connected to the second end of the at least one alignment positioning bar;

g) an ankle pads support frame rigidly connected proximal to the first end of the at least one alignment positioning bar;

h) at least one ankle pad mounted on the ankle pads support frame; and i) a resistance mechanism operatively connected to at least one component of the indirect alignment pivot mechanism;

wherein during operation of the machine, the integrated motions of the drive bar, the at least one alignment positioning bar, the at least one slide carriage, the ankle pads support frame, and the at least one ankle pad create an indirect alignment of the user's ankle path of motion with the path of motion of the at least one ankle pad.

2. The indirect alignment pivot mechanism for seated leg exercising machines of claim 1, wherein the at least one ankle pad is positioned to only engage the front of the user's legs to resist the motion of a leg extension exercise.

3. The indirect alignment pivot mechanism for seated leg exercising machines of claim 1, wherein the at least one ankle pad is positioned to only engage the back of the user's legs to resist the motion of a leg curl exercise.

4. The indirect alignment pivot mechanism for seated leg exercising machines of claim 1, wherein one of the at least one ankle pad is positioned on the front of the user's legs to resist the exercise motion of a leg extension and another separate one of the at least one ankle pad is positioned on the back of the user's legs to resist the opposite direction exercise motion of a leg curl.

5. The indirect alignment pivot mechanism for seated leg exercising machines of claim 4, wherein the indirect alignment pivot mechanism is operatively connected to the resistance mechanism that provides reciprocating resistance to the indirect alignment pivot mechanism such that a leg extension exercise motion is resisted by the resistance mechanism and an opposite leg curl exercise motion is resisted by the resistance mechanism in a single reciprocating pushing leg extension exercise motion and return pulling leg curl exercise motion.

6. The indirect alignment pivot mechanism for seated leg exercising machines of claim 5, wherein the machine further comprises one user support and multiple exercise stations.

7. The indirect alignment pivot mechanism for seated leg exercising machines of claim 5, wherein the machine further comprises multiple user supports and multiple exercise stations.

8. The indirect alignment pivot mechanism for seated leg exercising machines of claim 1, wherein the structural support frame is stationary during operation of the exercise station.

9. The indirect alignment pivot mechanism for seated leg exercising machines of claim 1, wherein at least a portion of the structural support frame is movable during operation of the exercise station.

10. The indirect alignment pivot mechanism for seated leg exercising machines of claim 2, wherein the resistance mechanism is adjustable prior to or during operation of the machine.

11. The indirect alignment pivot mechanism for seated leg exercising machines of claim 3, wherein the resistance mechanism is adjustable prior to or during operation of the machine.

12. The indirect alignment pivot mechanism for seated leg exercising machines of claim 5, wherein the resistance mechanism is adjustable prior to or during operation of the machine.

13. The indirect alignment pivot mechanism for seated leg exercising machines of claim 2, wherein independent left and right side indirect alignment pivot mechanisms for leg exercising machines are structured to create a single exercise station such that the user's left ankle engages a left side indirect alignment pivot mechanism ankle pad and the user's right ankle engages a right side indirect alignment pivot mechanism ankle pad.

14. The indirect alignment pivot mechanism for seated leg exercising machines of claim 3, wherein independent left and right side indirect alignment pivot mechanisms for leg exercising machines are structured to create a single exercise station such that the user's left ankle engages a left side indirect alignment pivot mechanism ankle pad and the user's right ankle engages a separate right side indirect alignment pivot mechanism ankle pad.

15. The indirect alignment pivot mechanism for seated leg exercising machines of claim 5, wherein independent left and right side indirect alignment pivot mechanisms for leg exercising machines are structured to create a single exercise station such that the user's left ankle engages a left side indirect alignment pivot mechanism ankle pads and the user's right ankle engages a separate right side indirect alignment pivot mechanism ankle pads.

* * * * *